US005720623A

United States Patent [19]

Polenick et al.

[11] Patent Number: 5,720,623

[45] Date of Patent: Feb. 24, 1998

[54] POSITION ASSURANCE ELECTRICAL CONNECTOR

[75] Inventors: Richard James Polenick; William Leonard Stein, Sr., both of Warren, Ohio

[73] Assignee: General Motors Corporation, Detroit, Mich.

[21] Appl. No.: 661,284

[22] Filed: Jun. 10, 1996

[51] Int. Cl.[6] ..... H01R 13/627

[52] U.S. Cl. ..... 439/352

[58] Field of Search ..... 439/350, 352, 439/357, 488, 489, 358, 353

[56] References Cited

U.S. PATENT DOCUMENTS

| | | | |
|---|---|---|---|
| 5,120,255 | 6/1992 | Kouda et al. | 439/489 |
| 5,186,663 | 2/1993 | Wymelenberg | 439/843 |
| 5,605,471 | 2/1997 | Plyler | 439/489 |

*Primary Examiner*—Neil Abrams
*Assistant Examiner*—Yong Ki Kim
*Attorney, Agent, or Firm*—Cary W. Brooks; Ernest E. Helms

[57] ABSTRACT

An electrical connector is provided including a first connector body for mounting a first terminal, the first connector body having a lock ramp, a second connector body for mounting a second terminal, the second connector body having a base portion with a flexible lock arm, the lock arm having a slot to receive the lock ramp of the first connector body to secure the first and second connector bodies together upon relative movement of the first and second connector bodies toward one another, and a connector assurance clip slidably mounted on the second connector body with a pusher block and a target, the connector assurance clip being slidably mounted on the second connector body adjacent the lock arm, the connector assurance clip having a first detented position with respect to the second connector body securing the connector assurance clip with the second connector body with the pusher block of the connector assurance clip being positioned within the slot of the lock arm, and wherein a force applied to the target of the connector assurance clip can move the connector assurance clip to a second detented position with respect to the second connector body, and wherein the connector assurance clip cannot be moved from the first detented position to the second detented position without the lock ramp of the first connector body moving the pusher block of the connector assurance clip from the lock arm slot.

7 Claims, 3 Drawing Sheets

POSITION ASSURANCE ELECTRICAL CONNECTOR

FIELD OF THE INVENTION

The field of the present invention is that of electrical connectors, particularly electrical connectors utilized for automotive applications where the assurance of electrical connection is mandated.

BACKGROUND OF THE INVENTION

Automotive electrical connections are generally performed by bringing two connectors halves, a male and a female, containing electrical terminations into contact and locking them securely. Various locking methods are available. One popular connection technique employs a flexible lock arm and a mating lock ramp. The lock arm is typically placed on the female half of the connector. The lock ramp is on the male half of the connector. The male and female connector halves are brought together. The lock arm position is deflected upward by an inclined surface of the lock ramp as it proceeds forward and thereafter the lock arm falls into a locked position on a flat side of the lock ramp. However, due to circumstances, such as poor accessibility or excessive connector mating force, there is a possibility of an assembler not always achieving the fully locked position of the connector. The above described position can leave the lock arm in a deflected position on the lock ramp. Subsequently, outside forces can possibly dislodge the connector and disconnect the associated electrical circuits.

To prevent the above described phenomena, a connector position assurance device can be utilized so that there is confirmation that the primary locking mechanism between two connector halves is engaged. Generally, connector position assurance devices of the past were installed as separate loose pieces or semi-attached to the connector halves via a tether mechanism. It is desirable that a connector be provided having a connector position assurance device which is already connected or prestaged with one of the connector halves.

SUMMARY OF THE INVENTION

To meet the above noted desire, the present invention is brought forth. The present invention, in a preferred embodiment, provides an electrical connector having a connector position assurance device of a molded plastic structure.

The connector position assurance device has a forward pusher block and dual supporting side rails with integral lock detents and a rear thumb pad. The connector position assurance device of the present invention is designed to assemble to a connector half via manual insertion from a rear of the female half. During assembly, the connector position assurance device is moved forward until lock detents of the connector position assurance device engage a first of two pairs of holes on side walls of the female connector half. The afore-described movement is to a prestaged assembly neutral position. The prestaged position allows a full range of motion to a lock arm. The lock arm remains in a prestage position until the female connector half is assembled to the mating male connector half.

After mating, the assembler pushes on the connector position assurance device thumb pad to move the connector position assurance device forward until the lock detents engage a second pair of holes in the side walls of the female connector half. During the above described motion, if the lock arm is not installed in its fully locked position, the connector position assurance device pusher block contacts a portion of the lock arm and forces the lock arm over the edge of the lock ramp to its final position. If the female connector half is installed correctly, the connector position assurance device slides forward until the lock detents engage in the second afore-described side holes and the thumb pad rests underneath a rear release pad of the lock arm. When the connector position assurance device thumb pad is under the lock arm rear release pad, the rear release pad cannot be depressed to disengage the lock arm from its installed position.

Using the connector position assurance device of the present inventive connector assures that the primary locking mechanism (of the connector) is engaged. The connector position assurance device also reduces the possibility of disconnects thereby increasing the reliability of the overall electrical connector. Prestaging of the connector position assurance device is highly desirable and beneficial in automotive assembly operations, lowering possibilities for incorrect assembly practices.

Other advantages of the present invention will become apparent to those skilled in art as the revelation of the present invention is brought forth in the accompanying drawings and detailed description.

DETAILED DESCRIPTION OF THE DRAWINGS

Figure 1:
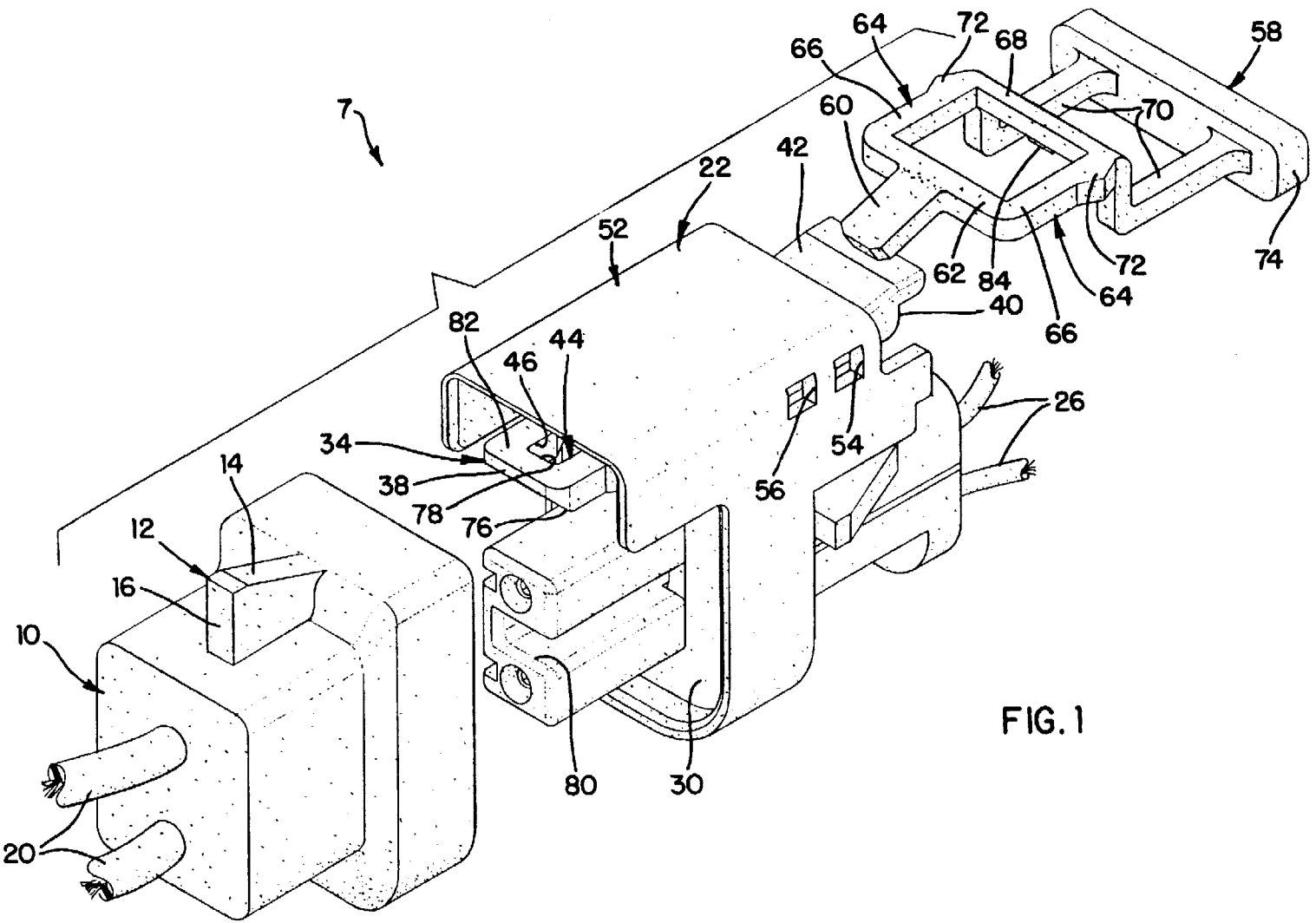
FIG. 1 is an exploded view of a preferred embodiment electrical connector of the present invention showing the primary components of the male connector half or body, the female connector half or body and a connector assurance clip.

Referring to FIGS. 1 through 5, the connector 7 of the present invention has a male connector half or body 10. The male connector body 10 has a lock ramp 12 with an inclined surface 14 with a flat side 16. The male connector body mounts two generally parallel pin terminals 18. The pin terminals 18 are electrically connected with cables 20 or other described electrical conductors. In many applications, although not required, the male connector body 10 will be stationary and will be locationally situated in an area of low accessibility.

The male connector body 10 will typically be fabricated from glass filled nylon molded plastic or other suitable electrical insulating material. It should also be noted, that the male connector body 10 is typically referred to as the male connector due to the fact that it mounts the male terminals which are the pin terminals 18.

To mate with the male connector body, there is a female connector body 22. The female connector body 22 mounts two female terminals 24. The female terminals can be according to those shown and described in Wymelenberg, U.S. Pat. No. 5,186,663 (commonly assigned) or other suitable alternatives.

The female terminals are correspondingly crimped onto the conductor electrical cables 26. In a manner similar to that shown and described in Francis U.S. Ser. No. 08/578,416, filed Dec. 26, 1995, (commonly assigned), the cables 26 can be sealed with a boot seal (not shown) and the boot seals and female terminals 24 will be held in position by a terminal assurance clip (not shown) which locks onto lock ramp 32.

As will be apparent to those skilled in the art, a male connector body interface 28 and corresponding female connector body interface 30 will be sealed when mated by an O-ring juxtaposed therebetween (not shown).

The female connector body 22 has a flexible lock arm 34. The lock arm 34, like the remainder of the female body 22, is fabricated from polyphthalamide molded plastic or other suitable materials. The lock arm 34 is supported from a column 36 and has a front end 38 and a rear end 40. The rear end 40 also has integrally joined thereto a presentation ramp 42. Lock arm 34 also has a longitudinal slot 44 with a small width section 46, a large width section 50 and a transitional section 48.

The female connector body 22 also has a cover 52. The cover 52 has transversely aligned first detent holes or windows 54 and second detent holes or windows 56. To provide for connector position assurance, there is a clip 58. The clip 58 has a pusher block 60. The pusher block 60 is connected to a frontal cross rail 62 which is, in ram, connected with two side rails 64. Each side rail has an upper portion 66 which is, in turn, joined to a rear cross rail 68. Each side rail also has a lower L-shaped portion 70. The upper portion 66 both have protruding laterally detent lock ramps 72. The L-shaped portions 70 are also joined to a rear section target or thumb tab 74.

Typically, the male connector body 10 will already be installed in the vehicle. The female connector body 22 will be connected to the cables 26. Prior to the mating of the female connector body 22 to the male connector body 10, the clip 58 will be inserted to the female connector body 22 by placement of the clip 58 between the presentation ramp 42 and the cover 52. The clip 58, which is made of glass filled nylon molded plastic and is pushed forward until the detent lock ramp 72 is entrapped within the first detent windows 54. In this position, the clip 58 can be shipped with the female connector body 22 along with the accompanying wire harness which is inclusive of the cables 26 to an assembly facility. The pusher block 60 is inclined downward approximately 15 degrees with respect to the frontal cross rail 62 and upper portion 66.

Figure 2:
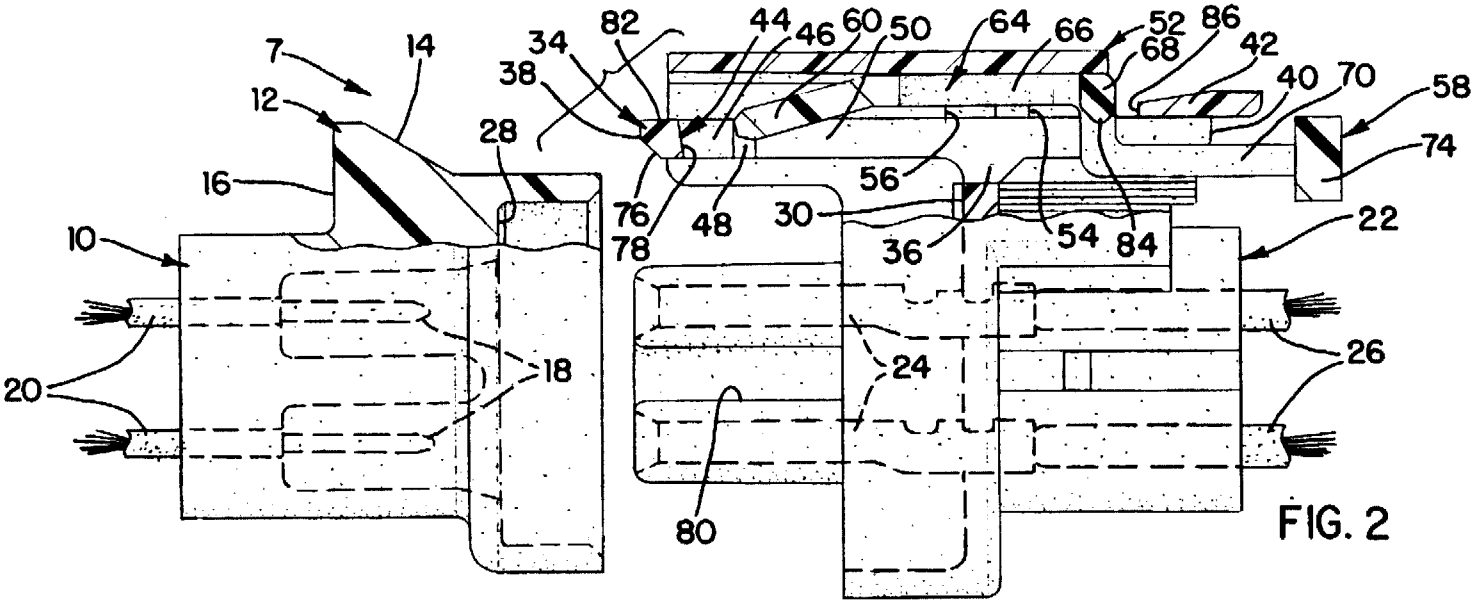
FIG. 2 is a side elevational view (partially sectioned) of the connector shown in FIG. 1 with the connector position assurance clip inserted within the female body before mating with the male body.
Figure 3:
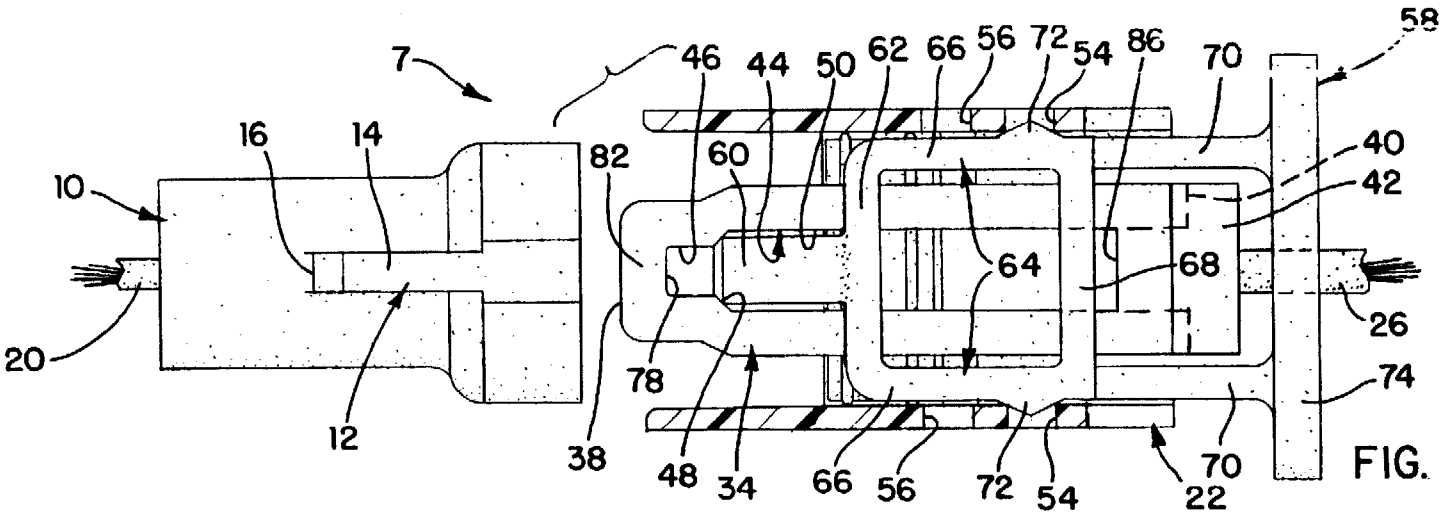
FIG. 3 is a top plan view of the connector shown in FIG. 2 with portions sectioned for illustration.

As best shown in FIGS. 2 and 3, the connector 7 is now ready for assembly. As the female connector body 22 is brought along to mate with the male connector body 10, to a position shown in FIG. 4, the inclined surface 14 of the lock ramp 12 will push upward against inclined surface 76 of the lock arm 34. The lock arm front end 38 will pivot upwardly about the column 36 until such time that a front edge 78 of the slot 44 can in turn fall down about the flat side 16 of the lock ramp 12.

In a manner well known to those skilled in the art, a top female connector body longitudinal groove 80 will mate with a corresponding internal tongue (not shown) of the male connector body to help align the pin terminals 18 with the female terminals 24. When the male connector body 10 is fully mated with the female connector body 22, the lock ramp 12 of the male connector body will have displaced the pusher block 60 of the clip 58 upwardly to be on top of the lock ramp 12. The vehicle assembler can then push the thumb tab forwardly causing the clip 58 to flex moving the lock ramps 72 from the first detent windows 54 to the second detent windows 56. The pusher block 60 is inclined from the frontal cross rail 62 and typically contacts the transition section 48. Therefore, if assembly is incomplete, the clip 58 will be prevented from moving forwardly, therefore giving a tactile indication to the assembler that a proper electrical connection has not been made. Additionally, the assembler will be able to see the thumb tab 74 being distant from the presentation ramp 42. To aid in this visual indicator, various color schemes may be utilized to highlight the fact that the thumb tab 74 is distant from the presentation ramp 42.

In cases where the connection has not been fully made, the application of the force on the thumb tab 74 will cause the pusher block 60 to hit the transition section 48 thereby pushing the female connector body 22 into a position where a proper connection will be made.

Figure 4:
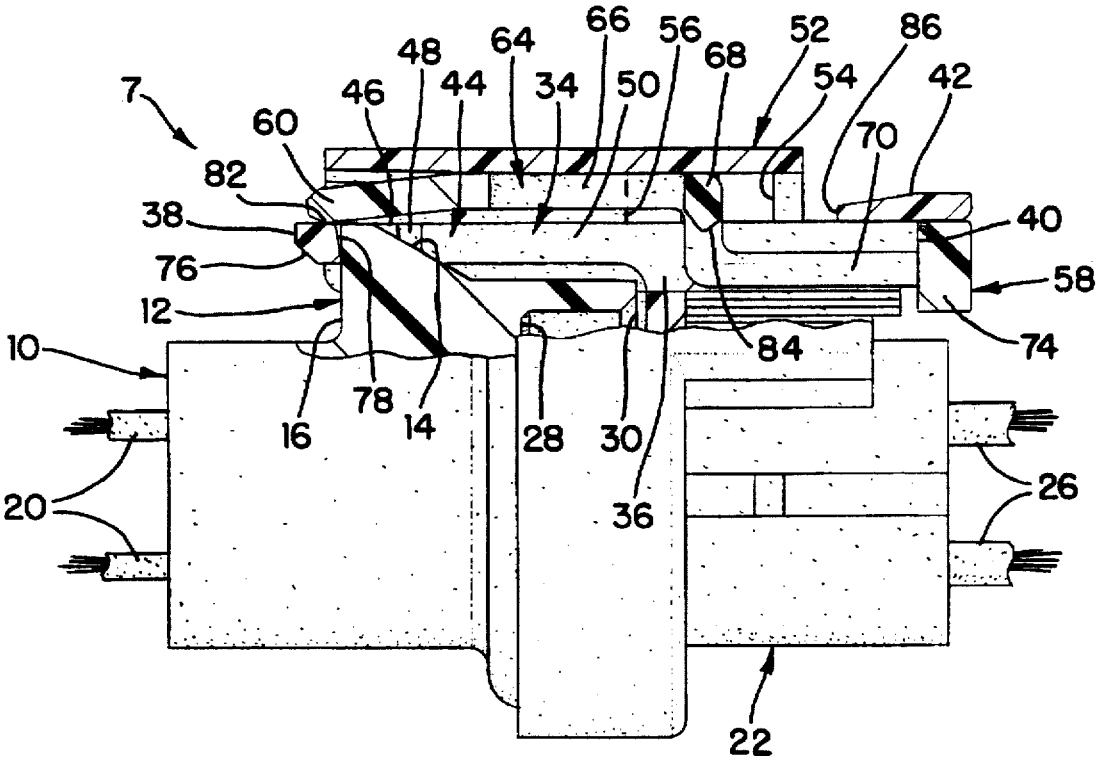
FIG. 4 is a figure similar to that of FIG. 2 showing the male and female bodies mated.
Figure 5:
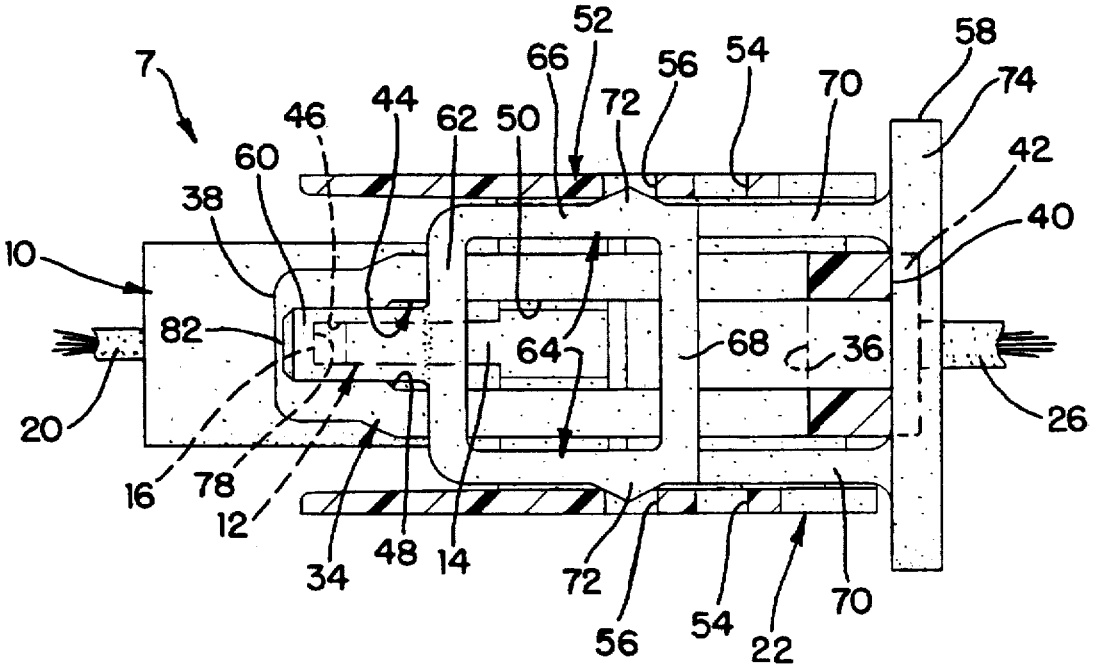
FIG. 5 is a view similar to that of FIG. 3 showing the male and female bodies mated.

As shown in FIGS. 4 and 5, when a proper connection has been made, the thumb tab 74 will be placed directly underneath the presentation ramp 42. When the thumb tab 74 is underneath the presentation ramp 42 as shown in FIG. 4, with the pusher block on an opposite side along a forward section 82 of the lock arm, the lock arm 39 cannot pivot upwardly and the clip 58 acts as a secondary locking feature for the connector 7.

It is desirable that when disassembling the connector 7 for service, that there be something to ensure that the clip 58 continues connection with the female connector body 22. To aid in the above connection, the rear cross rail of the clip has a descending tab 84 which hits a rear end of the slot 44. Therefore, if a repair man inadvertently pulls too hard such that the detent lock ramps move rearwardly (to the fight as shown in FIGS. 2 through 4) of the first detent windows 54, the clip 58 will still be connected with the female connector body 22.

While this invention has been described in terms of a preferred embodiment thereof, it will be appreciated that other forms could be adapted by one skilled in the art. Accordingly, the scope of this invention is to be considered limited only by the following claims.

What is claimed is:

1. A connector for electrically mating a first conductor to a second conductor comprising:

a first terminal for electrical connection with the first conductor;

a first connector body for mounting the first terminal, the first connector body having a lock ramp;

a second terminal for electrical connection with a second conductor;

a second connector body for mounting the second terminal, the second connector body having a base portion with a flexible lock arm, the lock arm having a slot to receive the lock ramp of the first connector body to secure the first and second connector bodies together upon relative movement of the first and second connector bodies toward one another;

a connector assurance clip slidably mounted on the second connector body with a pusher block and a target, the connector assurance clip being slidably mounted on the second connector body adjacent the lock arm, the connector assurance clip having a first detented position with respect to the second connector body securing the connector assurance clip with the second connector body with the pusher block of the connector assurance clip being positioned within the slot of the lock arm, and wherein a force applied to the target of the connector assurance clip can move the connector assurance clip to a second detented position with respect to the second connector body, and wherein the connector assurance clip cannot be moved from the first detented position to the second detented position without the lock ramp of the first connector body moving the pusher block of the connector assurance clip from the lock arm slot; and the assurance clip in the second detented position having a section on an opposite side of the lock arm than the pusher block to prevent pivotal movement of the lock arm.

2. A connector as described in claim 1 wherein the slot in the lock arm has a rear end and the clip has a stop member that engages the rear end to deter removal of the connector assurance clip from the second connector body.

3. A connector as described in claim 1 wherein the target is a thumb tab.

4. A connector for electrically mating a first conductor to a second conductor comprising:

a first terminal for electrical connection with the first conductor;

a first connector body for mounting the first terminal, the first connector body having a lock ramp;

a second terminal for electrical connection with a second conductor;

a second terminal for electrical connection with a second conductor;

a second connector body for mounting the second terminal, the second connector body having a base portion with a flexible lock arm, the lock arm having a slot to receive the lock ramp of the first connector body to secure the first and second connector bodies together upon relative movement of the first and second connector bodies toward one another;

a connector assurance clip slidably mounted on the second connector body with a pusher block and a target, the connector assurance clip being slidably mounted on the second connector body adjacent the lock arm, the connector assurance clip having a first detented position with respect to the second connector body securing the connector assurance clip with the second connector body with the pusher block of the connector assurance clip being positioned within the slot of the lock arm, and wherein a force applied to the target of the connector assurance clip can move the connector assurance clip to a second detented position with respect to the second connector body, and wherein the connector assurance clip cannot be moved from the first detented position to the second detented position without the lock ramp of the first connector body moving the pusher block of the connector assurance clip from the lock arm slot;

a connector wherein the assurance clip in the second detented position has a second on an opposite side of the lock arm than the pusher block to prevent pivotal movement of the lock arm; and the second connector body having walls generally adjacent the connector assurance clip, the walls having sequentially located windows and the connector assurance clip having at least one lock ramp to establish the detented positions with respect to the second connector body.

5. A connector as described in claim 4 wherein the connector assurance clip has two side rails joined by at least one cross rail wherein there is a lock ramp on each side rail.

6. A connector as described in claim 5 wherein the slot in the lock arm has a first smaller width and a second larger width and the pusher block is sized to have a width between the two and wherein the pusher block is inclined into the slot allowing the pusher block to push the second connector body towards the first connector body if proper connection between the first and second connector bodies has not been achieved.

7. A connector for electrically mating a first conductor to a second conductor comprising:

a first terminal for electrical connection with the first conductor;

a first connector body for mounting the first terminal, the first connector body having a lock ramp;

a second terminal for electrical connection with a second conductor;

a second connector body for mounting the second terminal, the second connector body having a base portion with a flexible lock arm, the lock arm having a slot to receive the lock ramp of the first connector body to secure the first and second connector bodies together upon relative movement of the first and second connector bodies toward one another;

a connector assurance clip slidably mounted on the second connector body with a pusher block and a target, the connector assurance clip being slidably mounted on the second connector body adjacent the lock arm, the connector assurance clip having a first detented position with respect to the second connector body securing the connector assurance clip with the second connector body with the pusher block of the connector assurance clip being positioned within the slot of the lock arm, and wherein a force applied to the target of the connector assurance clip can move the connector assurance clip to a second detented position with respect to the second connector body, and wherein the connector assurance clip cannot be moved from the first detented position to the second detented position without the lock ramp of the first connector body moving the pusher block of the connector assurance clip from the lock arm slot;

a connector wherein the assurance clip in the second detented position has a second on an opposite side of the lock arm than the pusher block to prevent pivotal movement of the lock arm;

the slot in the lock arm having a first smaller width and a second larger width and the pusher block being sized to have a width between the two and the pusher block being inclined into the slot allowing the pusher block to push the second connector body towards the first connector body if proper connection between the first and second connector bodies has not been achieved.

* * * * *